US012152395B2

(12) United States Patent
Anderson

(10) Patent No.: US 12,152,395 B2
(45) Date of Patent: Nov. 26, 2024

(54) COVING INSTALLATION DEVICE

(71) Applicant: Richard Ted Anderson, Whitman, MA (US)

(72) Inventor: Richard Ted Anderson, Whitman, MA (US)

( * ) Notice: Subject to any disclaimer, the term of this patent is extended or adjusted under 35 U.S.C. 154(b) by 278 days.

(21) Appl. No.: 17/655,290

(22) Filed: Mar. 17, 2022

(65) Prior Publication Data

US 2022/0298806 A1 Sep. 22, 2022

Related U.S. Application Data

(60) Provisional application No. 63/162,722, filed on Mar. 18, 2021.

(51) Int. Cl.

| | |
|---|---|
| ***B25B 11/00*** | (2006.01) |
| ***E04F 19/04*** | (2006.01) |
| ***E04F 21/00*** | (2006.01) |

(52) U.S. Cl.

CPC ..... *E04F 21/0069* (2013.01); *E04F 19/0436* (2013.01); *E04F 19/045* (2013.01); *E04F 19/0463* (2013.01)

(58) Field of Classification Search

CPC ..... A63H 33/04; A63H 33/046; B25B 11/00; H01R 13/6205

See application file for complete search history.

(56) References Cited

U.S. PATENT DOCUMENTS

| | | | | |
|---|---|---|---|---|
| 8,991,801 | B2 * | 3/2015 | Plaszewski | H01F 7/0252 335/289 |
| 10,106,996 | B2 * | 10/2018 | Erdman | E04G 21/1841 |
| 11,715,664 | B2 * | 8/2023 | Saito | H01L 21/68707 269/8 |
| 2010/0120322 | A1 * | 5/2010 | Vicentelli | A63H 33/046 446/92 |
| 2014/0070472 | A1 * | 3/2014 | Plaszewski | B25B 11/002 269/8 |
| 2016/0184727 | A1 * | 6/2016 | Ornstein | A63H 33/046 446/92 |
| 2017/0095747 | A1 * | 4/2017 | Cheung | A63H 33/046 |
| 2022/0298806 | A1 * | 9/2022 | Anderson | E04F 19/045 |

* cited by examiner

*Primary Examiner* — Lee D Wilson

(74) *Attorney, Agent, or Firm* — Dunlap Bennett & Ludwig, PLLC; Anna L. Kinney

(57) ABSTRACT

A coving installation device includes a unitary structure having a first magnetic face, a second magnetic face, and a third magnetic face. The second face is joined with the first face by an arced side. The third face is joined with the second face by a linear side. The third face is joined with the first face by an angled side. The second face is perpendicular to the first face and the third face is perpendicular to the second face. The first, second, and third faces protrude from the arced, linear, and angled sides. A clean room installer using the coving installation device can independently install coving without assistance.

14 Claims, 4 Drawing Sheets

COVING INSTALLATION DEVICE

CROSS-REFERENCE TO RELATED APPLICATION

This application claims the benefit of priority of U.S. provisional application No. 63/162,722, filed Mar. 18, 2021, the contents of which are herein incorporated by reference.

BACKGROUND OF THE INVENTION

The present invention relates to clean room coving installation and, more particularly, to a coving installation device.

Cove trim or coving trim covers a transition between surfaces. In the construction of a clean room, all inside corners must have cove trim installed to enable the efficient cleaning of the surfaces. The installation of coving trim and cove retainer or coving retainer in the upper perimeter of a clean room under construction is a difficult process. It is more difficult if the worker is alone as the material is often long. A single worker may use a suction cup on a wall panel to support one end of the material, but the process is cumbersome, increases the risk of injuries due to dropped objects, and adds man hours to a "clean room" project. Often the material falls off the suction cup due to its configuration. Therefore, most clean room installers use 2 workers to install long lengths of cove and cove retainer. Manpower shortages complicate the immediate availability of the second worker.

As can be seen, there is a need for a device that simplifies the process of installing coving and enables a single worker to efficiently install coving alone.

SUMMARY OF THE INVENTION

In one aspect of the present invention, a coving installation device is provided, comprising a unitary structure having a first magnetic face; a second magnetic face, perpendicular to the first magnetic face, joined with the first magnetic face via an arced side; and a third magnetic face, perpendicular to the second magnetic face, joined with the second magnetic face via a linear side; wherein the third magnetic face is joined with the first magnetic face via an angled side; and wherein the first magnetic face, the second magnetic face, and the third magnetic face protrude from the arced side, the linear side, and the angled side.

The present invention enables a "clean room" installer to work more efficiently, eliminating the need for unskilled assistants, reducing the risk of injury to workers in the area, and reducing the risk of damage to other components. A clean room installer may independently install coving with reduced man hours, making a clean room contractor more competitive.

These and other features, aspects and advantages of the present invention will become better understood with reference to the following drawings, description, and claims.

DETAILED DESCRIPTION OF THE INVENTION

Figure 1:
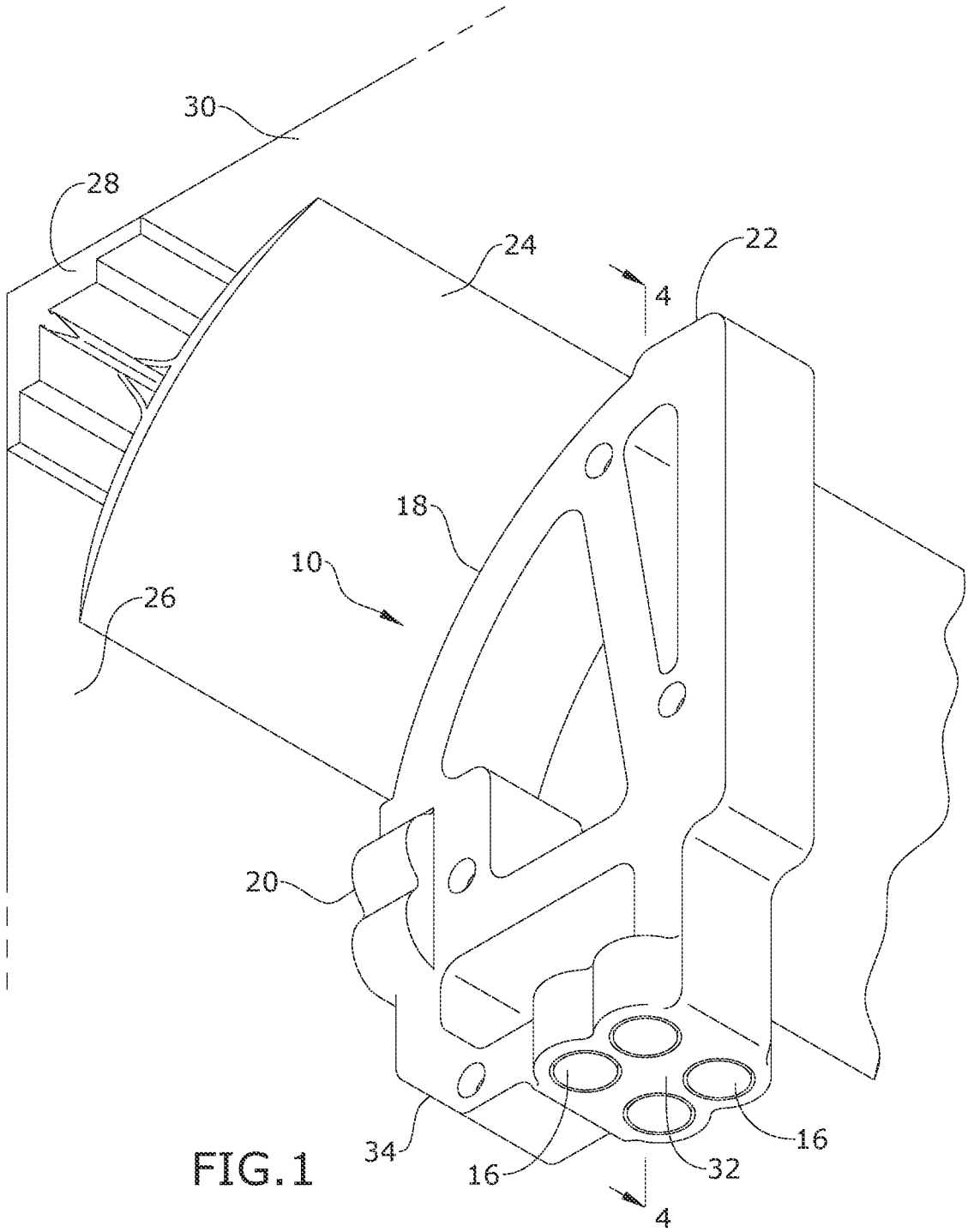
FIG. 1 is a bottom front perspective view of a clean room cove installation device according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a coving installation device that supports coving trim during the installation process. It also aligns the coving trim with the coving retainer, facilitating installation.

The device is sometimes referred to herein as "COVEMATE".

Relatively short coving material may be supported with a single device. Longer coving materials (such as 10') may be supported with multiple devices, e.g., placed at ⅓ intervals along the coving length. The device may also support vertical cove retainers at a predetermined height.

In some embodiments, the device may have magnets embedded in a surface, such as on the top surface and/or on at least one side. These integral magnets enable support of the coving material as well as more efficient alignment and installation of other clean room fixtures. The worker may install the fasteners without assistance from another worker. For example, the device may support speakerphones as they are fastened to wall panels.

The device may be used in a "clean room" which has metal clad wall and ceiling panels already in place. The worker may support the cove retainer by placing the device underneath, against the vertical surface of a clean room wall panel where it interfaces with the ceiling, aligning the profile of the retainer with the corresponding side of the device. Once the cove retainer is attached to an upper inside corner of the wall, the device may be inverted and used to support the next component (i.e., the cove). Depending upon the length of the piece, the installer may utilize more than one device in different locations to install the cove into the retainer. The cove may be slid into place between the device and the retainer at an end furthest from the installer. The installer may then insert the cove into the cove retainer, working toward the inventive device. The cove may be slid left or right to align with an inside wall corner and may be snapped in place in the retainer with a rubber mallet. Once the cove is installed such that it is supported and aligned with the cove retainer, the device may be removed from the wall.

The device may be three-dimensionally (3D) printed or injection molded from any suitable plastic material. For example, the device may be printed in two mirror-image pieces that are bolted together. One portion of the device matches the profile of the cove retainer and an opposite portion of the device matches the profile of the cove. Then a series of small magnets may be glued in place with epoxy adhesive.

The inventive device may be used to measure lengths of material by placing it at one end of the material and hooking a tape measure onto the device.

Figure 2:
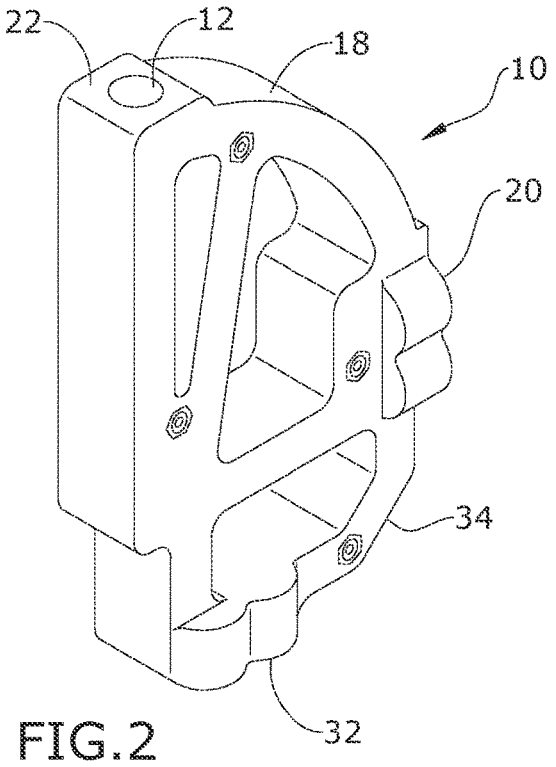
FIG. 2 is a rear top perspective view thereof.
Figure 3:
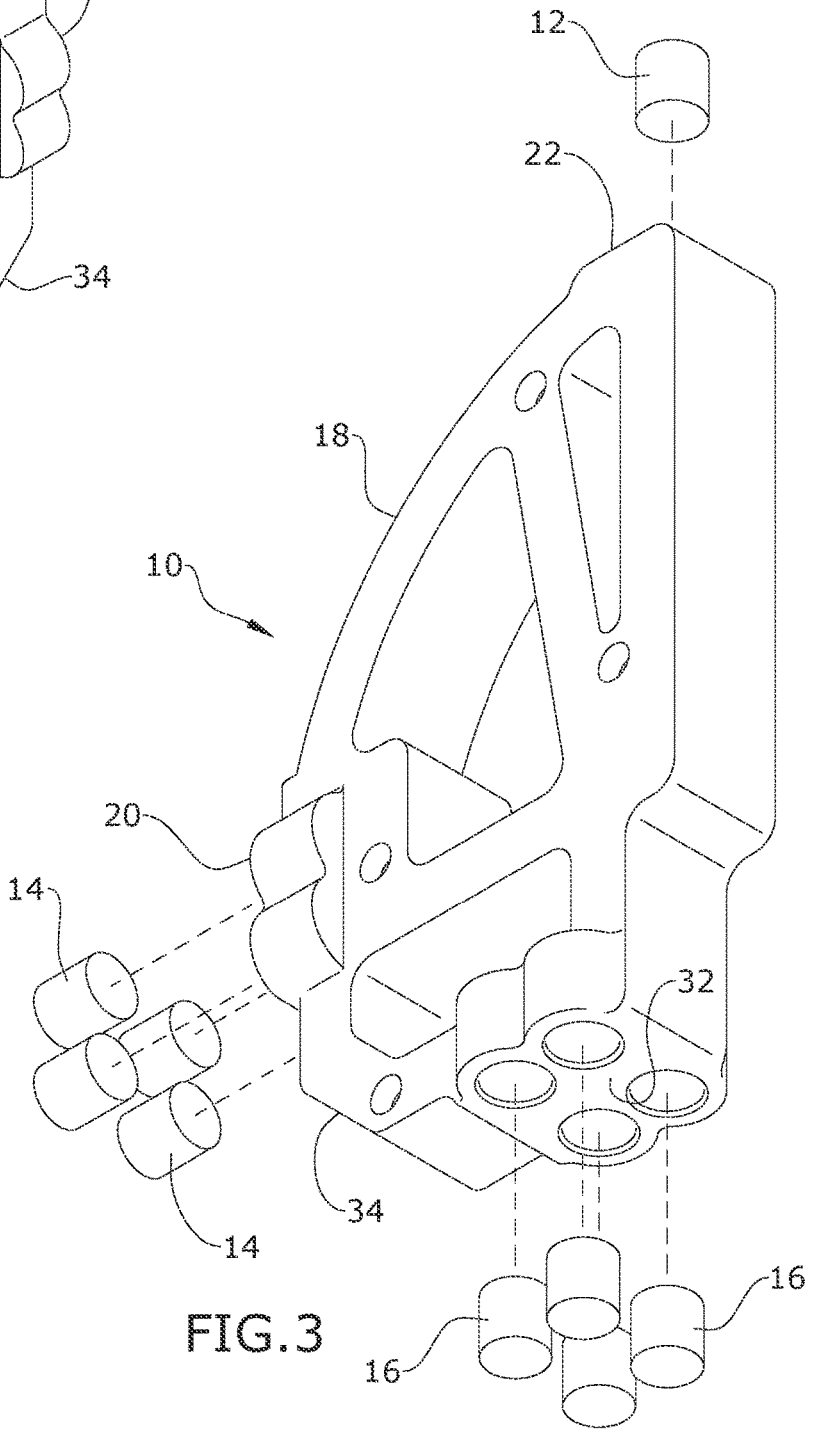
FIG. 3 is an exploded bottom rear perspective view thereof.
Figure 4:
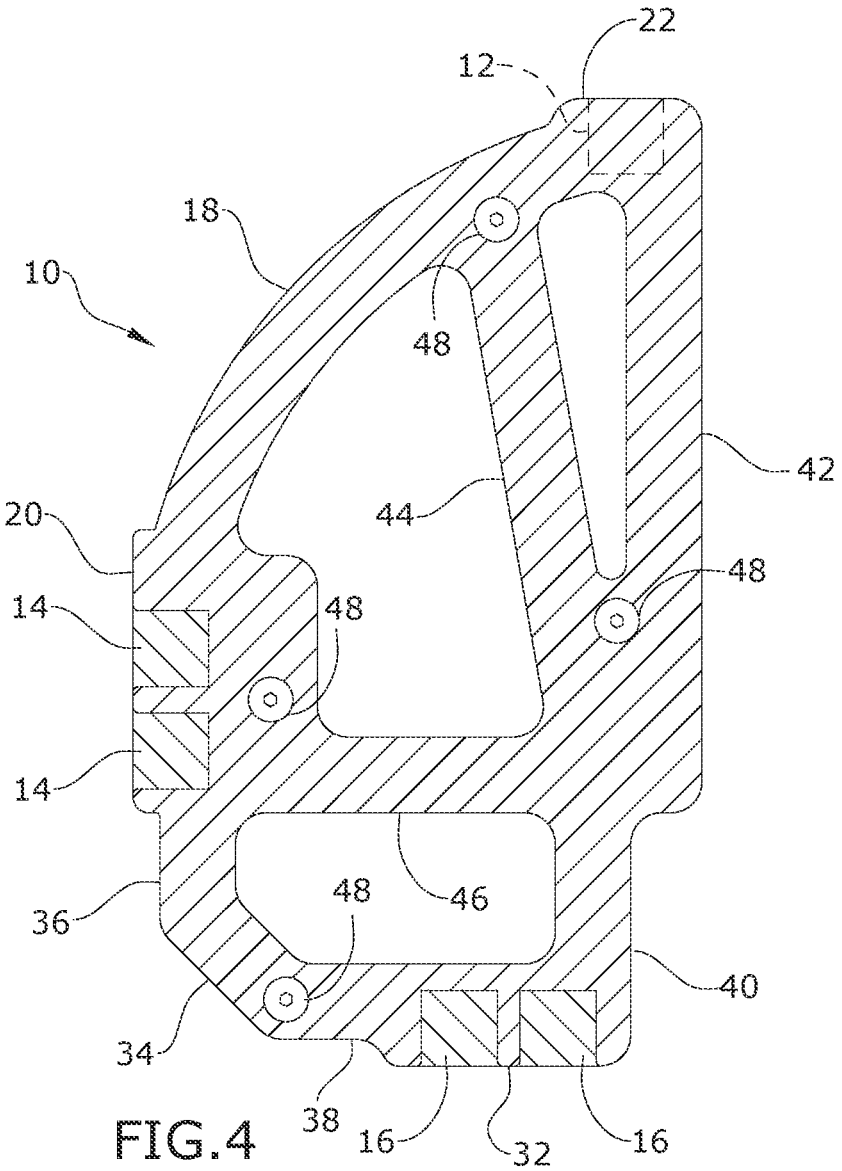
FIG. 4 is a sectional view taken along line 4-4 in FIG. 1.
Figure 5:
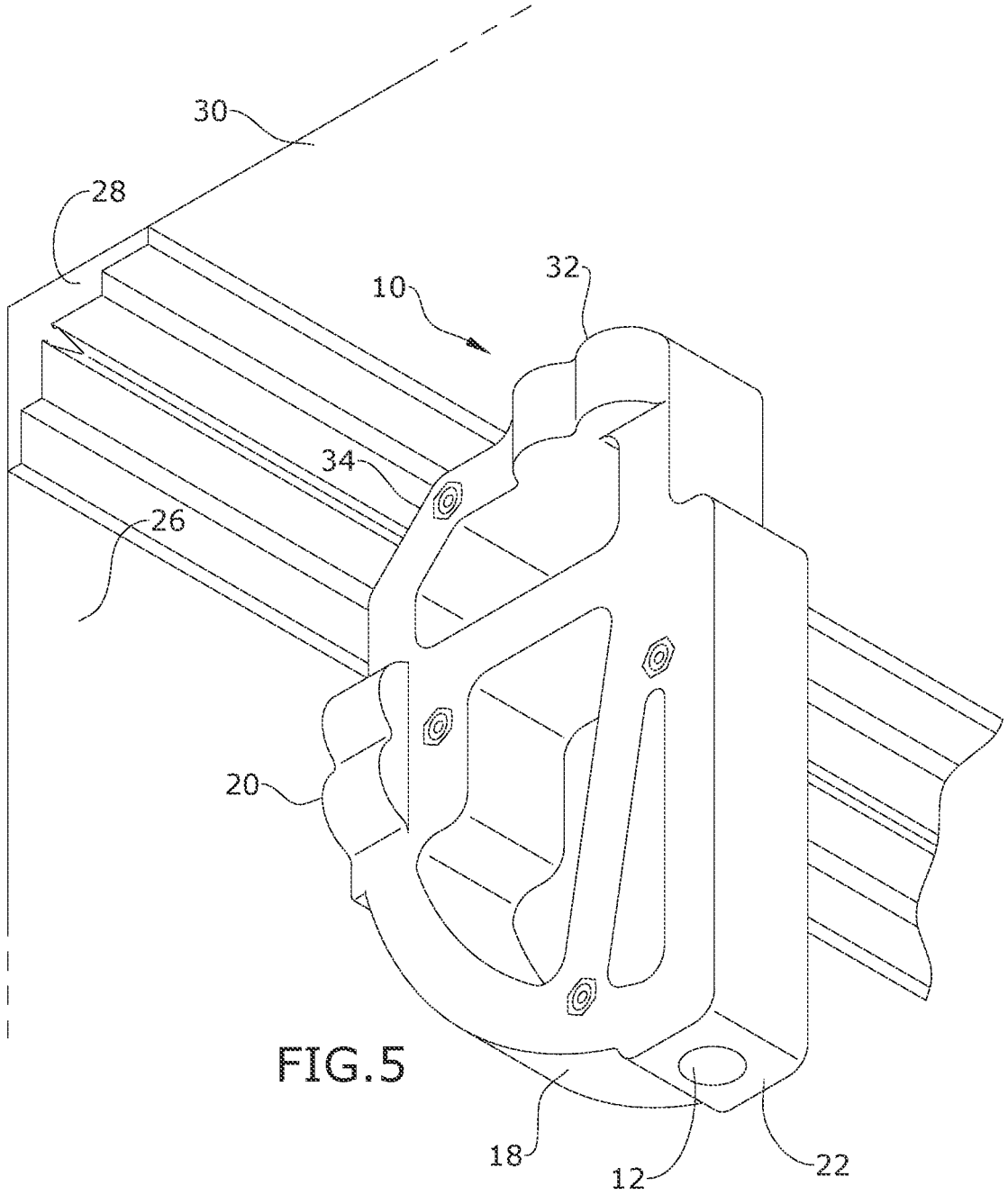
FIG. 5 is a perspective view thereof, shown in an alternate use.

Referring to FIGS. 1 through 5, FIG. 1 shows a device 10 according to an embodiment of the present invention, exhibiting a roughly "D"-shaped structure, shown in use supporting a trim piece 24 for installation onto a retainer 28 at an intersection between a first clean room wall 26 and a second clean room wall 30. The device 10 is a unitary structure, or two merged mirrored unitary structures, having a plurality of faces 20, 22, 32 protruding from device sides 18, 34, 36, 38, 40, 42 and having structural ribs 44, 46 extending therebetween. The device 10 surfaces have rounded edges. Each of the protruding faces 20, 22, 32 contains at least one magnet 12, 14, 16, enabling the device to simultaneously magnetically attach to components in three distinct directions. As shown in FIGS. 2-4, a first face 20 containing a plurality of magnets 14 is joined via an arced side 18 with a second face 22 containing a single magnet 12. The first face 20 is perpendicular to the second face 22. Opposite and slightly offset from the second face 22, a third face 32 containing a plurality of bottom magnets 16 is joined with the second face via a linear side 42 having a recessed portion 40. The third face 32 has a parallel central axis to that of the second face 22. A first rib 46 extends perpendicularly from the linear side 42 to the first face 20 and a second rib extends at an acute angle from the linear side 42 to the arced side 18. The third face 32 is joined to the first face 20 by way of an angled side 34 having a first extension 36 joined with and parallel to the first face 20 and a second extension 38 joined with and parallel to the third face 32. The first extension 36 and the second extension 38 are shown at angles of about 60° from the angled side 34. The arced side 18 is configured to substantially conform to the profile of a curved surface of the cove trim 24 facing into the room when installed. The angled side 34, first extension 36, and second extension 38 are configured to approximate the angled surfaces of the cove retainer 28 facing into the room when installed. As shown in FIGS. 2 and 3, the magnets 12, 14, 16 are cylindrical. The magnetic faces 20, 32 that contain more than one magnet protrude laterally in a curved configuration to accommodate the width of the magnets. As shown in FIG. 4, attachment hardware 48 such as bolts may be used to connect two juxtaposed components having mirror image configurations, each having the unitary structure discussed herein. FIG. 5 illustrates the inventive device used in an inverted position supporting the retainer 28. The device 10 may also be used alone or in multiples, e.g., of 2, 3, etc., to support longer clean room components or to support additional components, such as to hold a lens (not shown) in place for leveling additional clean room components (not shown).

It should be understood, of course, that the foregoing relates to exemplary embodiments of the invention and that modifications may be made without departing from the spirit and scope of the invention as set forth in the following claims.

What is claimed is:

1. A coving installation device, comprising:

a unitary structure having:

a first magnetic face;

a second magnetic face, perpendicular to the first magnetic face, joined with the first magnetic face via an arced side; and a third magnetic face, perpendicular to the first magnetic face, joined with the second magnetic face via a linear side;

wherein the third magnetic face is joined with the first magnetic face via an angled side;

wherein the first magnetic face protrudes from a juncture of the arced side and the angled side, the second magnetic face protrudes from a juncture of the arced side and the linear side, and the third magnetic face protrudes from a juncture of the linear side and the angled side; and wherein the arced side is configured to conform to a concave surface of coving trim.

2. The coving installation device of claim 1, wherein a second unitary structure having a mirror-image configuration to the unitary structure is juxtaposed with the unitary structure and attached thereto with attachment hardware.

3. The coving installation device of claim 1, wherein the unitary structure further comprises a first structural rib extending between the linear side and the first magnetic face.

4. The coving installation device of claim 3, wherein the unitary structure further comprises a second structural rib extending between the linear side and the arced side.

5. The coving installation device of claim 1, wherein the unitary structure has rounded edges.

6. The coving installation device of claim 1, wherein the unitary structure is plastic and the first magnetic face, the second magnetic face, and the third magnetic face have at least one magnet embedded therein.

7. The coving installation device of claim 1, wherein the linear side has a recessed portion such that the second magnetic face is offset from the third magnetic face and has a parallel central axis thereto.

8. The coving installation device of claim 1, wherein the angled side has a first extension joined with and parallel to the first magnetic face and a second extension joined with and parallel to the third magnetic face; and wherein the first extension, the angled side, and the second extension are configured to conform to a coving retainer.

9. The coving installation device of claim 1, wherein the first magnetic face and the third magnetic face protrude laterally in a curved configuration.

10. The coving installation device of claim 3, wherein the first structural rib is orthogonal to the linear side.

11. The coving installation device of claim 3, wherein the linear side has a recessed portion and wherein the first structural rib, the recessed portion, the third face, and the angled side form an aperture therebetween that extends through the coving installation device.

12. The coving installation device of claim 3, further comprising a second structural rib joining a juncture of the linear side and the first structural rib to the arced side, wherein the first structural rib, the second structural rib, the arced side, and the first face form an aperture therebetween that extends through the coving installation device.

13. The coving installation device of claim 4, wherein the second structural rib, the arced side, the second magnetic face, and the linear side form a substantially V-shaped aperture therebetween that extends through the coving installation device.

14. The coving installation device of claim 1, wherein at least one component selected from the group consisting of the arced side, the linear side, and the angled side has a quadrilateral cross-section with rounded corners.

* * * * *